US005927705A

United States Patent [19]

Becker et al.

[11] Patent Number: 5,927,705

[45] Date of Patent: Jul. 27, 1999

[54] ENVELOPE FEEDER

[75] Inventors: Friedbert R. Becker; Christopher G. Chee; William J. Thornhill, all of Lexington, Ky.

[73] Assignee: Lexmark International, Inc., Lexington, Ky.

[21] Appl. No.: 08/852,370

[22] Filed: May 7, 1997

[51] Int. Cl.[6] ..... B65H 5/00

[52] U.S. Cl. ..... 271/114; 271/2; 271/10.13

[58] Field of Search ..... 271/114, 121, 271/122, 10.09, 10.11, 10.13

[56] References Cited

U.S. PATENT DOCUMENTS

| | | | |
|---|---|---|---|
| 3,612,511 | 10/1971 | Godlewski | 271/35 |
| 4,030,722 | 6/1977 | Irvine et al. | 271/10.13 |
| 4,438,915 | 3/1984 | Akamatsu et al. | 271/10.09 |
| 4,443,006 | 4/1984 | Hasegawa | 271/10.11 |
| 4,653,742 | 3/1987 | Sasaki et al. | 271/114 |
| 4,690,392 | 9/1987 | Coons, Jr. | 271/10.11 |
| 4,705,265 | 11/1987 | Hirota et al. | 271/122 |
| 4,927,130 | 5/1990 | Tanaka et al. | 271/114 |
| 5,265,857 | 11/1993 | Chiang | 271/10.13 |
| 5,451,042 | 9/1995 | Cuir et al. | 271/114 |
| 5,664,771 | 9/1997 | Nagatani et al. | 271/10.13 |

*Primary Examiner*—Christopher P. Ellis
*Assistant Examiner*—Gregory A. Morse
*Attorney, Agent, or Firm*—John A. Brady

[57] ABSTRACT

A stack of envelopes has its lowermost envelope advanced from the stack by two sets of longitudinally spaced kick rollers, which are driven through a gear train by a unidirectional motor. A separator, which includes a feed roll and a restraint roll driven by the unidirectional motor, allows only one envelope to pass therethrough. The gear train includes two sets of interrupted teeth on a gear for stopping advancement of each of the two sets of kick rollers so that another envelope is not advanced from the stack during a cycle of operation. The gear has a third set of interrupted teeth for stopping the feed and restraint rolls after the envelope has passed the separator. The envelope is advanced to a printer by drive rolls, which cooperate with spring biased back-up rolls to form a nip, driven by the unidirectional motor. When the envelope enters the drive rolls, a latch holds the gear having the interrupted teeth from rotating. When the envelope passes the drive rolls, the unidirectional motor is stopped, and the latch is released.

13 Claims, 12 Drawing Sheets

ENVELOPE FEEDER

FIELD OF THE INVENTION

This invention relates to an apparatus for feeding the lowermost envelope in a stack of envelopes from the stack and, more particularly, to a drive mechanism for insuring that only a single envelope is fed with the use of a unidirectional motor.

BACKGROUND OF THE INVENTION

Envelopes have previously been fed from the stack of envelopes by feeding the lowermost envelope in the stack. However, the prior drive systems have required a controllable clutch mechanism or a bi-directional motor so that it has been necessary to rotate the motor in reverse for a predetermined distance to unlatch a master gear clutch.

With this prior drive system, it has not been possible to continue cycling until the lowermost of the envelopes in the stack has been fed if the envelope is not fed during the first attempt. Instead, the prior drive systems have required the reversal of the motor to start another cycle even if there has been no successful feeding of the lowermost envelope.

SUMMARY OF THE INVENTION

The separating and feeding apparatus of the present invention overcomes the foregoing problems through utilizing a unidirectional motor in which there is no latching of a clutch until the envelope has passed the drive rolls. This enables continuous cycling until an envelope has been advanced to the drive rolls.

An object of this invention is to provide a bottom feed of envelopes in a stack with a unidirectional motor.

Other objects of th is invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
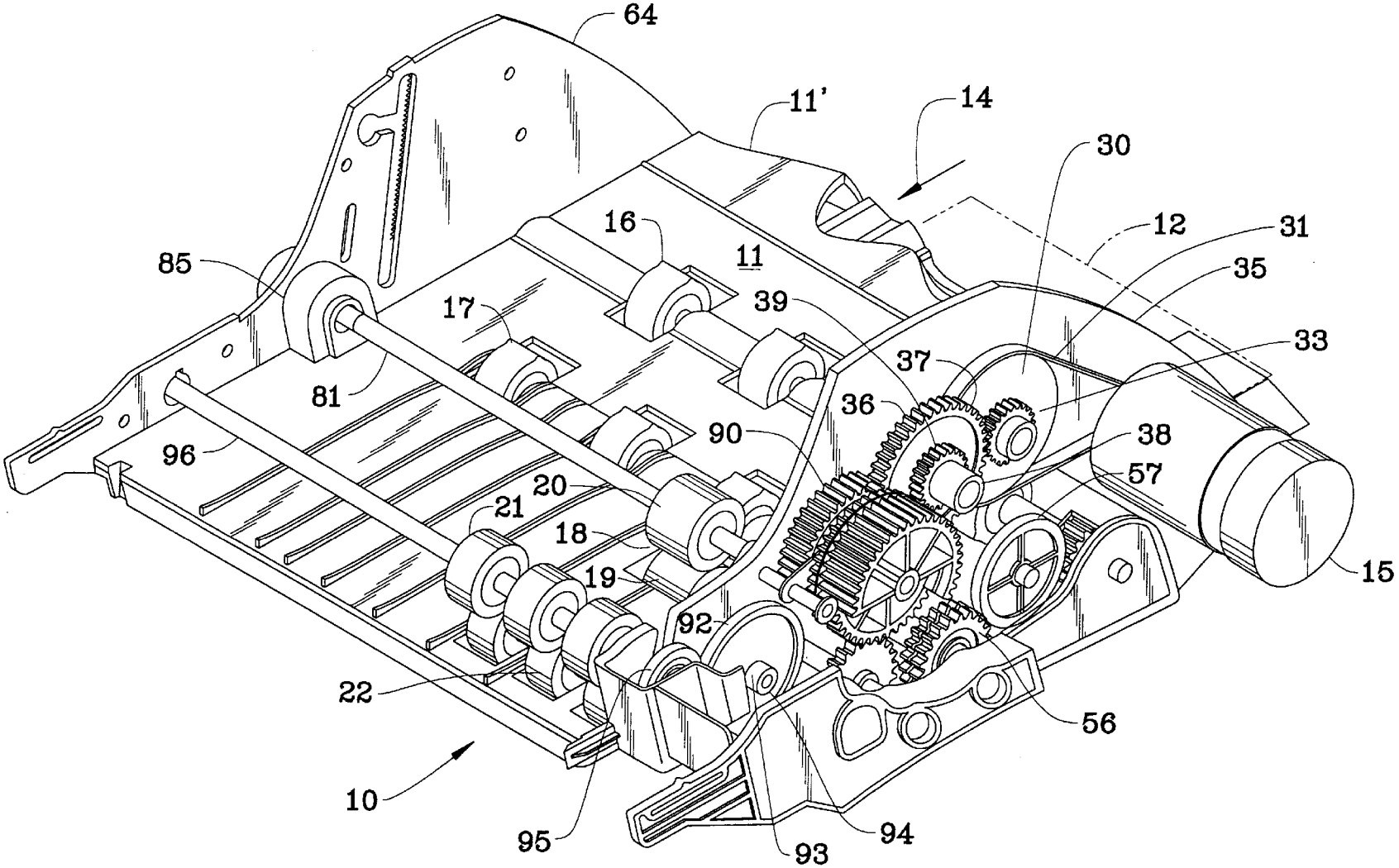
FIG. 1 is a perspective view of an automatic separating and feeding apparatus of the present invention with portions removed for clarity purposes.

Referring to the drawings and particularly FIG. 1, there is shown an automatic separating and feeding apparatus 10 including a floor 11 of a frame 11' on which is supported a stack of envelopes 12 (shown in phantom). The envelopes 12 are fed from the stack in the direction of an arrow 14. Accordingly, since the front of the apparatus 10 the direction from which the envelopes 12 are fed, in FIG. 1, the arrow 14 is at the front of the apparatus 10.

Figure 7:
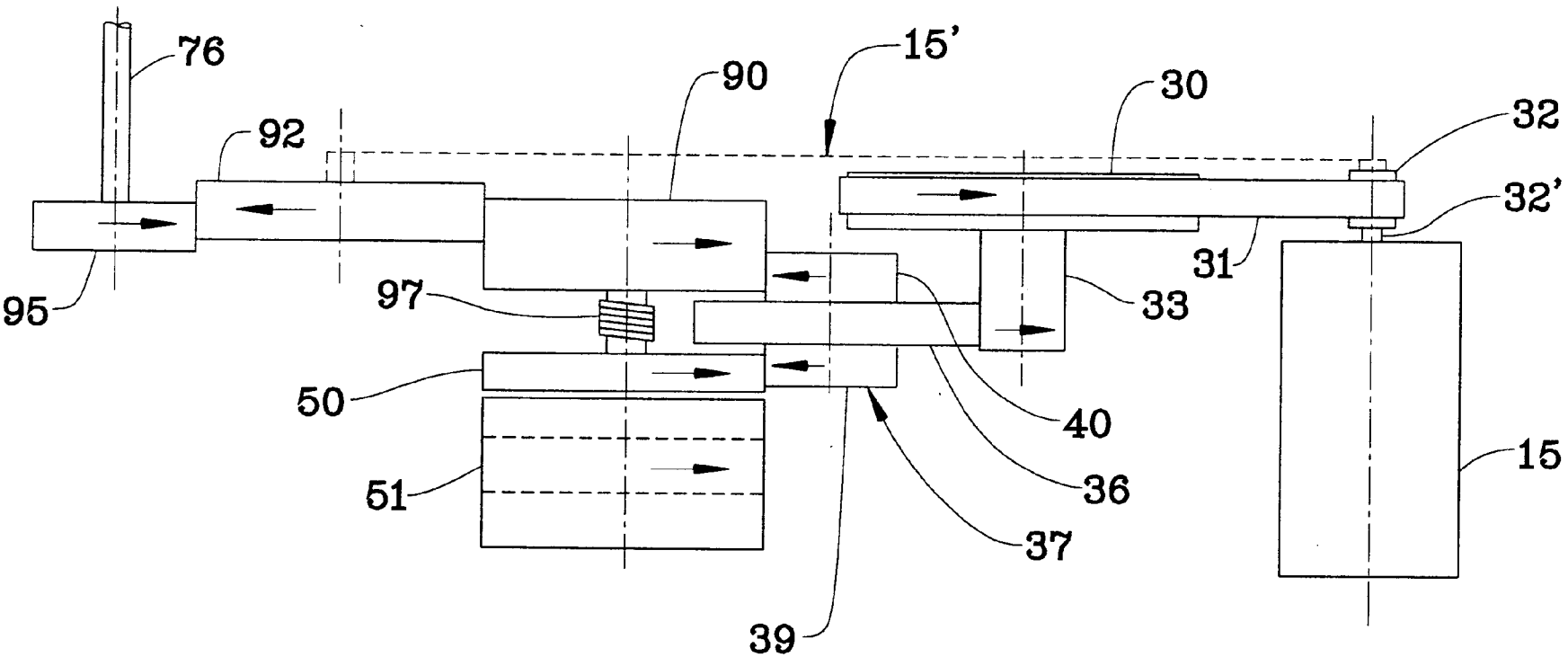
FIG. 7 is a schematic top plan view of a gear train of the separating and feeding apparatus of the present invention.

A unidirectional motor 15 is supported on the left side of the apparatus 10. The motor 15 is connected through a gear train 15', which is schematically shown in FIG. 7, to rotate a first set of kick rollers 16 (see FIG. 1) and a second set of kick rollers 17, which are longitudinally spaced from the first set of the kick rollers 16.

The kick rollers 16 and 17 are employed to advance the lowermost envelope 12 from the stack. The kick rollers 16 and 17 advance the envelope 12 through a separator 18, which allows only one of the envelopes 12 to be advanced past it.

The separator 18 includes a feed roll 19 and a restraint roll 20 forming a nip therebetween. The feed roll 19 and the restraint roll 20 are driven from the motor 15 through the gear train 15' (see FIG. 7).

Figure 8:
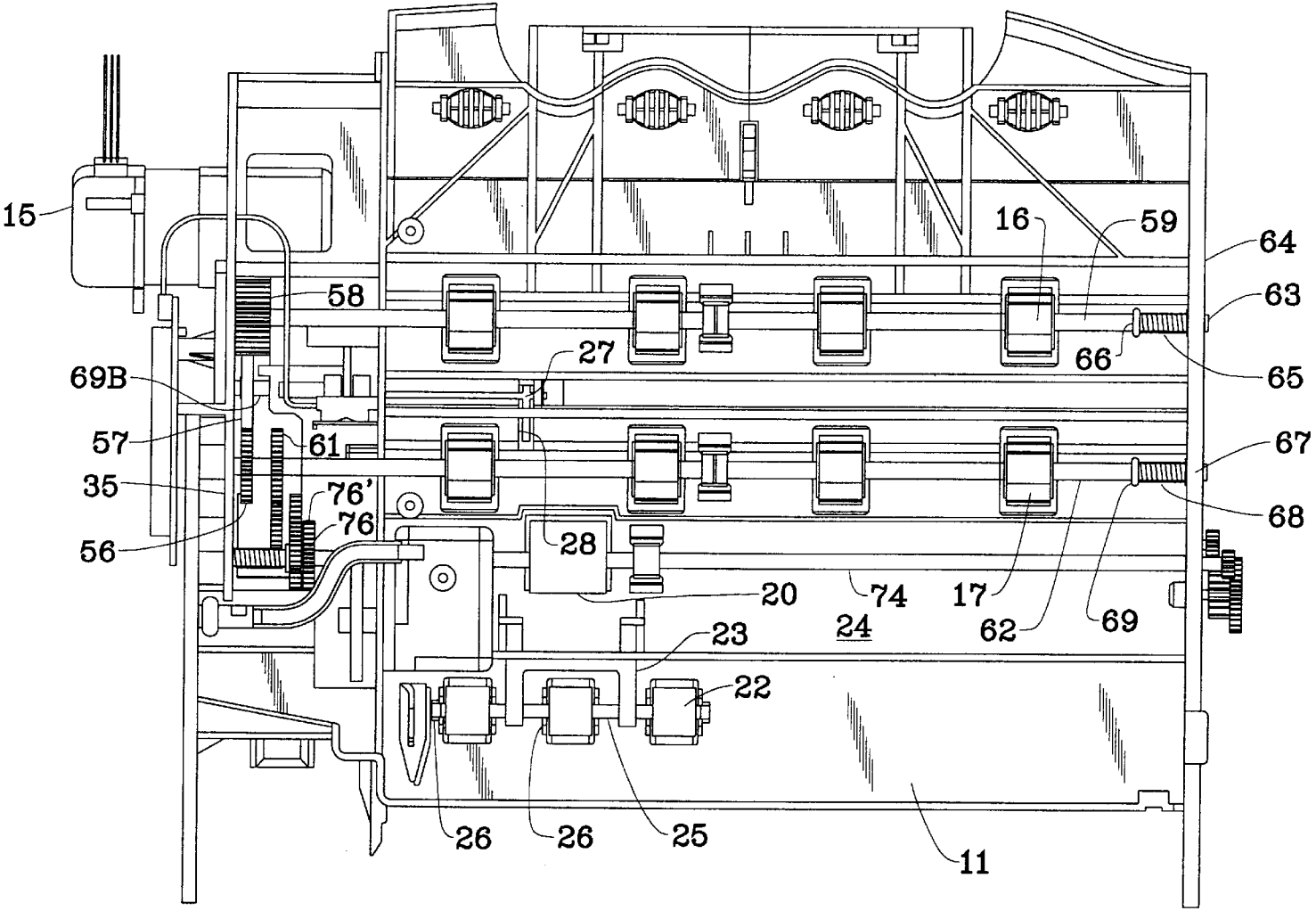
FIG. 8 is a bottom plan view of the automatic separating and feeding apparatus of FIG. 1.

Downstream from the separator 18 (see FIG. 1) is a plurality of drive rolls 21 cooperating with a plurality of back-up rolls 22. The back-up rolls 22 are resiliently biased against the drive rolls 21 by a H-shaped spring 23 (see FIG. 8), which is supported on a bottom surface 24 of the floor 11. The spring 23 acts against a shaft 25 on which the back-up rolls 22 rotate. The spring 23 holds the shaft 25 within guides 26 on the bottom surface 24 of the floor 11.

The drive rolls 21 (see FIG. 1) are driven by the motor 15 through the gear train 15' (see FIG. 7) to form a nip with the back-up rolls 22 (see FIG. 1) to advance the envelope 12 from the frame 11' to a process station of a printer (not shown).

Figure 9:
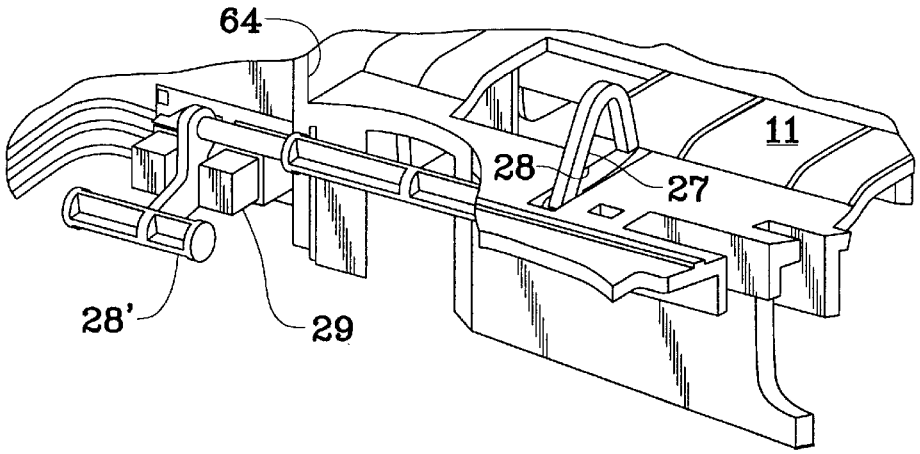
FIG. 9 is an enlarged fragmentary perspective view of a portion of the separating and feeding apparatus of the present invention and showing a sensor arrangement for sensing the absence of an envelope for feeding.

If none of the envelopes 12 is resting on the floor 11, a flag 27 (see FIG. 9) will extend up through a slot 28 in the floor 11 because of a weight 28', which is attached to the flag 27. This results in an optical sensor 29, which includes the flag 27, supplying a signal to a microprocessor (not shown) that none of the envelopes 12 (see FIG. 1) is available for supply to the printer. This causes a signal to appear to a user to supply the envelopes 12 to the floor 11 and prevents activation of the motor 15. One suitable example of the optical sensor 29 (see FIG. 9) is sold by Aleph Corporation as Part No. OJ-265631-601.

Figure 10:
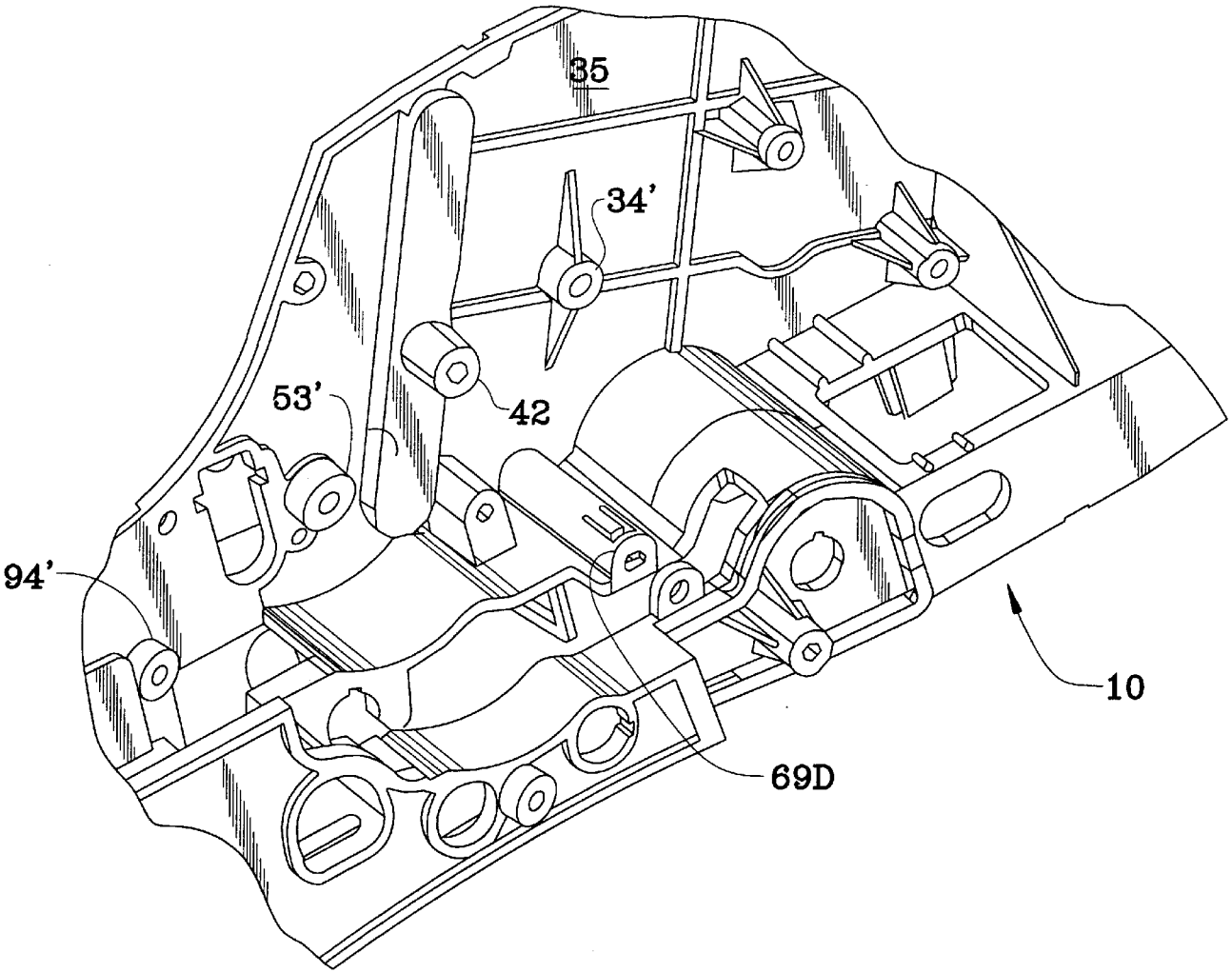
FIG. 10 is an enlarged fragmentary perspective view of a portion of the separating and feeding apparatus of the present invention and showing the arrangement of bosses on a side wall for support of various studs for supporting gears.

When the motor 15 (see FIG. 1) is energized by a signal from the microprocessor to advance the lowermost envelope 12 in the stack on the floor 11, the motor 15 (see FIG. 2) rotates a pulley 30 through a belt 31, which also passes around a pulley 32 (see FIG. 7) on a shaft 32' of the motor 15. The pulley 30 (see FIG. 2), which has a helical gear 33 integral therewith, is rotatably supported by a stud 34. The stud 34 is pressed into a boss 34' (see FIG. 10) on a left side wall 35 (see FIG. 1) of the frame 11' of the apparatus 10 for support thereby.

The helical gear 33 (see FIG. 2) meshes with a helical gear 36 of a compound gear 37. The compound gear 37 includes a hub 38 integral therewith. The compound gear 37 has a gear 39 on one side of the helical gear 36 and a gear 40 (see FIG. 7) on the other side of the helical gear 36.

The hub 38 (see FIG. 11) is rotatably mounted on a stud 41, which has one end pressed into a boss 42 (see FIG. 10) extending from the exterior of the left side wall 35 for support thereby. The other end of the stud 41 is attached to a metal aligner plate 43 (see FIG. 11).

The gear 39 meshes with a master cam gear 50 (see FIG. 6) to which is coupled a master/feed/kick gear 51. The master cam gear 50 has its hub 52 (see FIG. 4) rotatably supported on a stud 53 (see FIG. 11), which has one end pressed into a boss 53' (see FIG. 10) extending from the exterior of the left side wall 35 for support thereby. The other end of the stud 53 is connected to the metal aligner plate 43 (see FIG. 11). Likewise, the master/feed/kick gear 51 (see FIG. 3) has its hub 54 also rotatably supported by the stud 53 (see FIG. 1).

Figure 2:
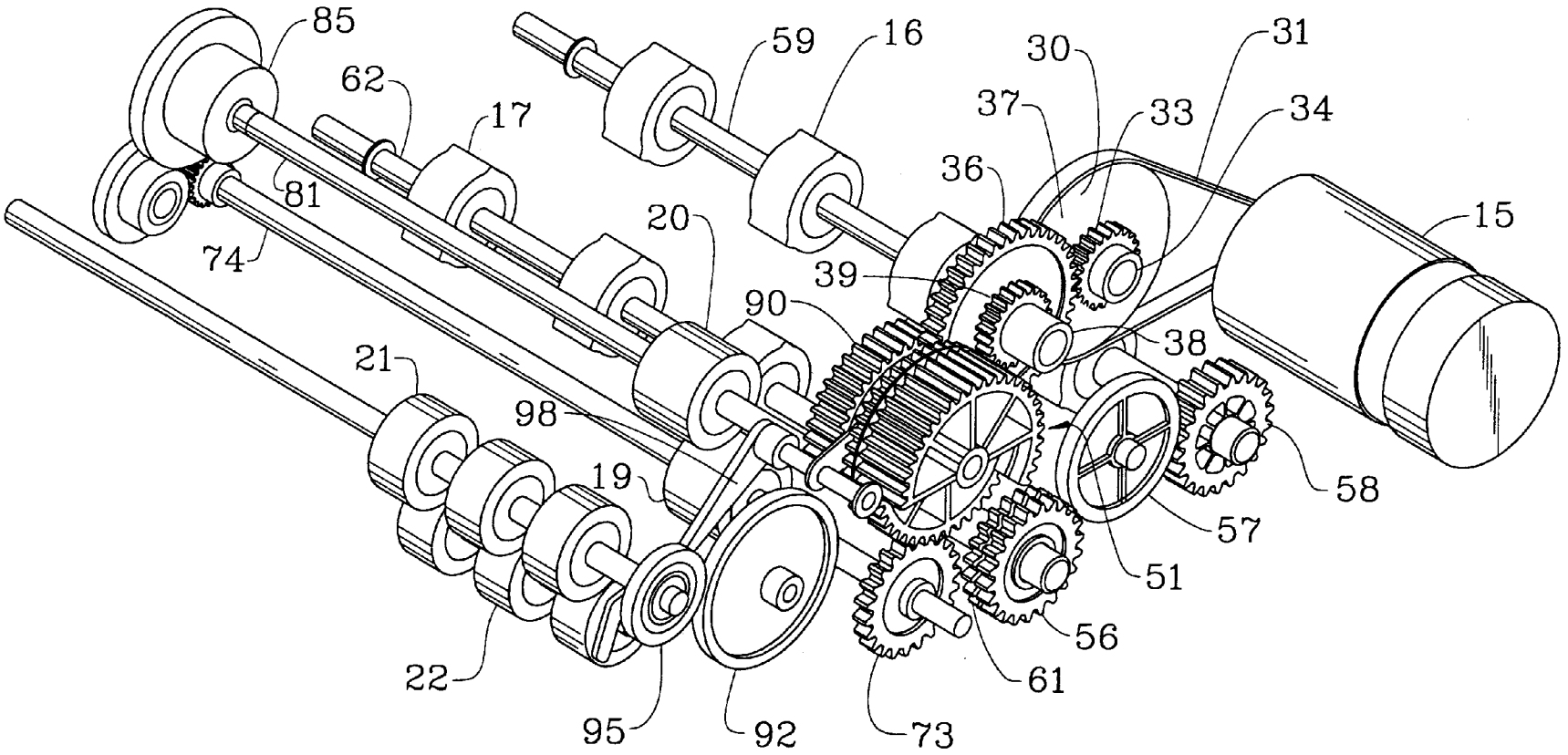
FIG. 2 is a perspective view of the drive mechanism of the separating and feeding apparatus of FIG. 1.

The master/feed/kick gear 51 (see FIG. 3) has a first set of teeth 55 for meshing with a first kick roller gear 56 (see FIG. 2). The first kick roller gear 56 meshes with an idler gear 57 for transmitting rotation from the first kick roller gear 56 to a drive gear 58 for the first set of the kick rollers 16. The drive gear 58 is fixed to a shaft 59 having the first set of the kick rollers 16 fixed thereto for rotation therewith.

The master/feed/kick gear 51 (see FIG. 3) has a second set of teeth 60 for causing rotation of the second set of the kick rollers 17 (see FIG. 2). The teeth 60 (see FIG. 3) mesh with a second kick roller gear 61 (see FIG. 2), which is fixed to a shaft 62 having the second set of the kick rollers 17 fixed thereto for rotation therewith.

Figure 13:
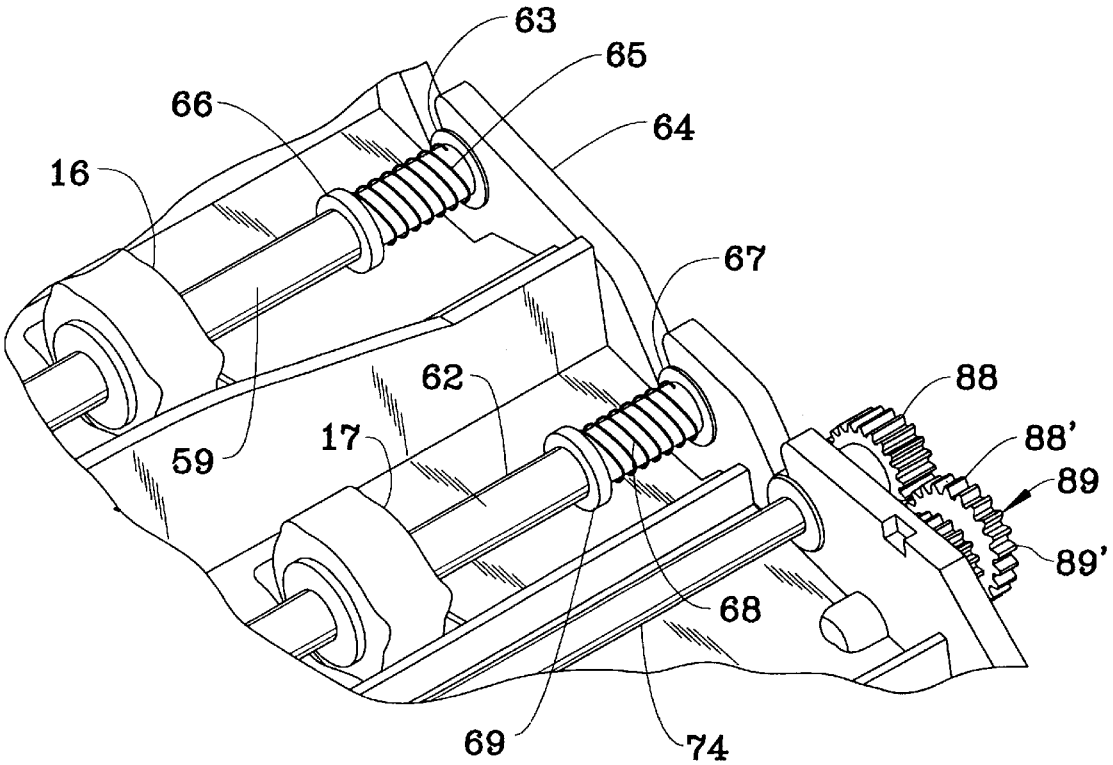
FIG. 13 is an enlarged fragmentary perspective view of a portion of the bottom of the separating and feeding apparatus of the present invention and showing a portion of the support arrangement for the kick roller support shafts and the feed roll shaft.

The shaft 59 has its ends rotatably supported in bearings 63 (see FIG. 13). The bearings 63 are supported by the left side wall 35 (see FIG. 8) and a right side wall 64 (see FIG. 13). A spring 65 surrounds the shaft 59 and acts on a collar 66 fixed to the shaft 59 to continuously urge the shaft 59 towards the left side wall 35 (see FIG. 8) to maintain the drive gear 58 disposed for engagement with the idler gear 57.

The shaft 62 is similarly rotatably supported in bearings 67 (see FIG. 13). The bearings 67 are similarly supported by the side walls 35 (see FIG. 8) and 64 (see FIG. 13), and the shaft 62 has a spring 68 and a collar 69 in the same manner as the shaft 59.

Figure 12:
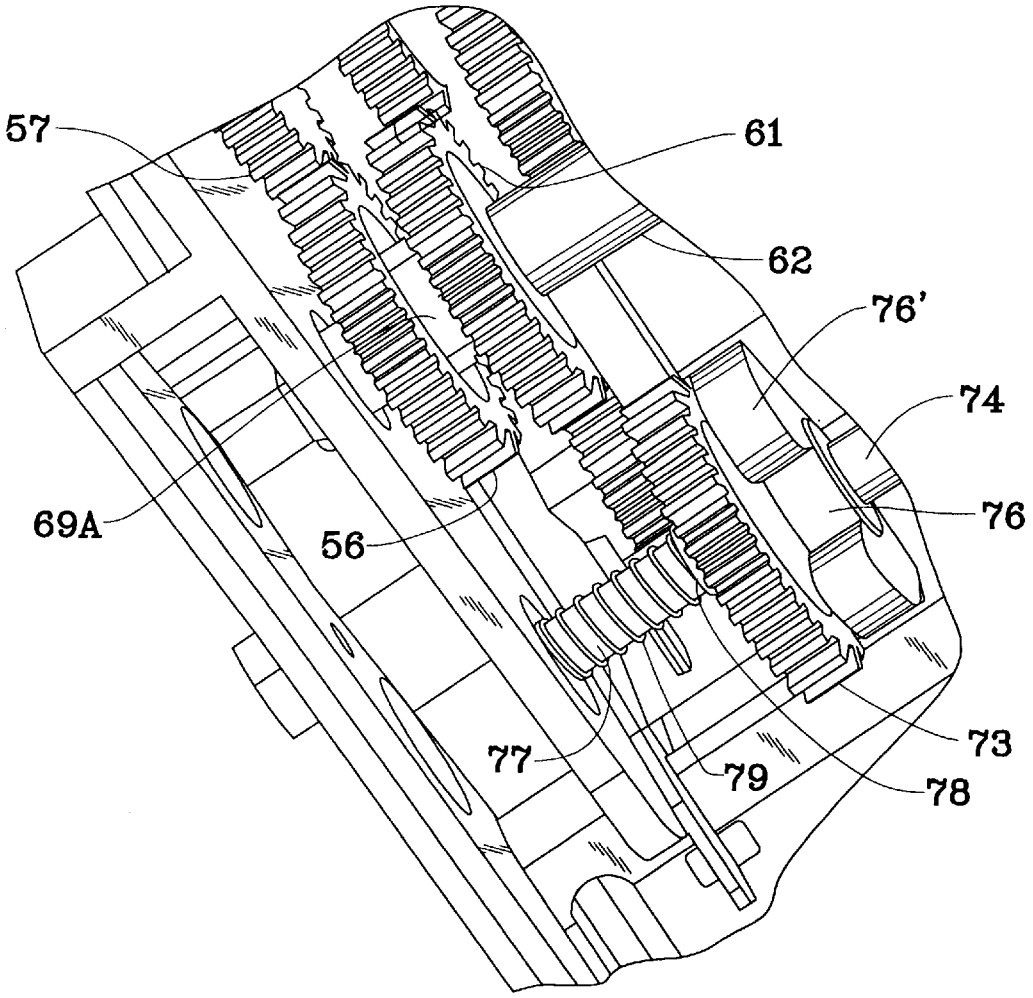
FIG. 12 is an enlarged fragmentary perspective view of a portion of the bottom of the separating and feeding apparatus of the present invention and showing part of a gear support arrangement.

The first kick roller gear 56 (see FIG. 12) has its hub 69A rotatably supported on the shaft 62. Thus, the first kick roller gear 56 rotates independently of the shaft 62. The spring 68 (see FIG. 8) maintains the first kick roller gear 56 disposed for engagement with the teeth 55 (see FIG. 3) on the master/feed/kick gear 51.

Figure 11:
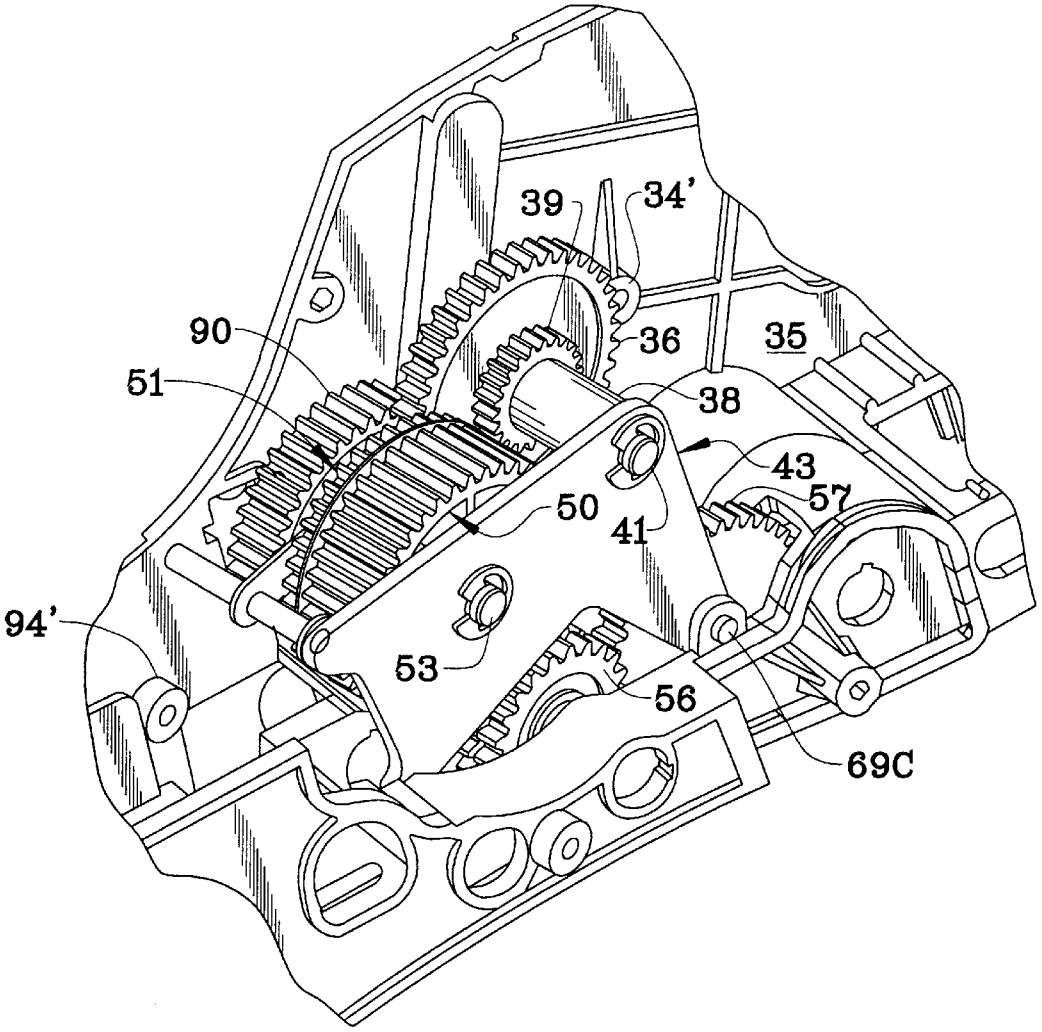
FIG. 11 is an enlarged fragmentary perspective view of a portion of the separating and feeding apparatus of the present invention and showing a portion of the gear train including an aligner plate having the ends of the support studs attached thereto.

The idler gear 57 (see FIG. 8) has its hub 69B rotatably supported by a stud 69C (see FIG. 11). The stud 69C is detented into a boss 69D (see FIG. 10) on the left side wall 35 for support thereby and is attached to the aligner plate 43 (see FIG. 11).

Figure 3:
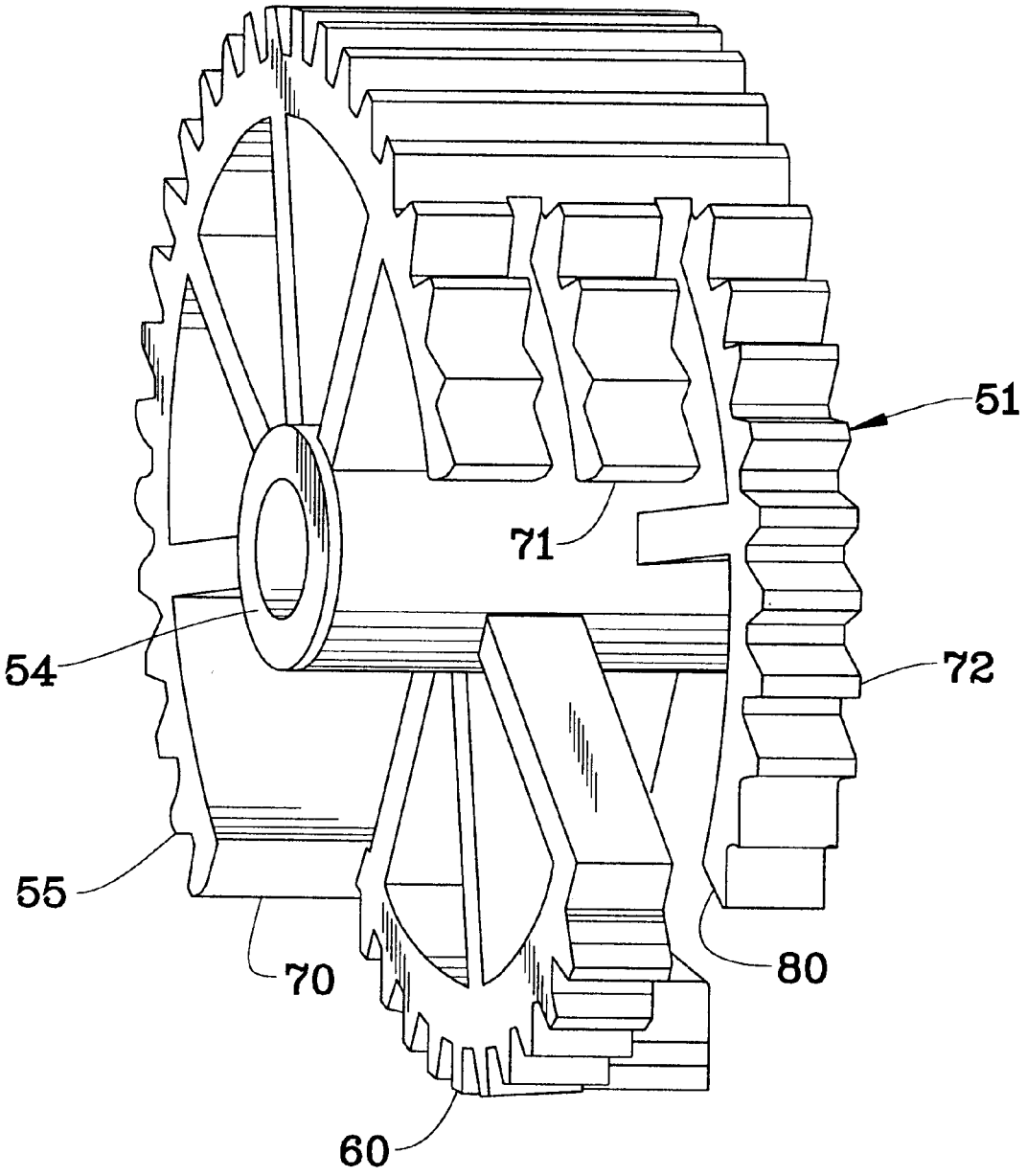
FIG. 3 is a perspective view of a master/feed/kick gear of a gear train of the present invention.

As shown in FIG. 3, the teeth 55 are interrupted by an open sector 70. Thus, the drive of the first set of the kick rollers 16 (see FIG. 2) is stopped before completion of rotation of the master/feed/kick gear 51 (see FIG. 3). The amount of rotation of the first set of the kick rollers 16 (see FIG. 1) is such that their rotation will stop just prior to when the trailing edge of the minimum size envelope 12 to be handled by the apparatus 10 would reach the kick rollers 16. Without the open sector 70 (see FIG. 3) in the teeth 55 of the master/feed/kick gear 51, the next adjacent of the envelopes 12 (see FIG. 1) would be driven forward from the stack.

Similarly, the teeth 60 have an open sector 71 (see FIG. 3) to interrupt the drive of the second set of the kick rollers 17 (see FIG. 2) before completion of rotation of the master/feed/kick gear 51. The rotation of the second set of the kick rollers 17 is stopped prior to when the trailing edge of the minimum size envelope 12 to be handled by the apparatus 10 would reach the kick rollers 17.

Figure 5:
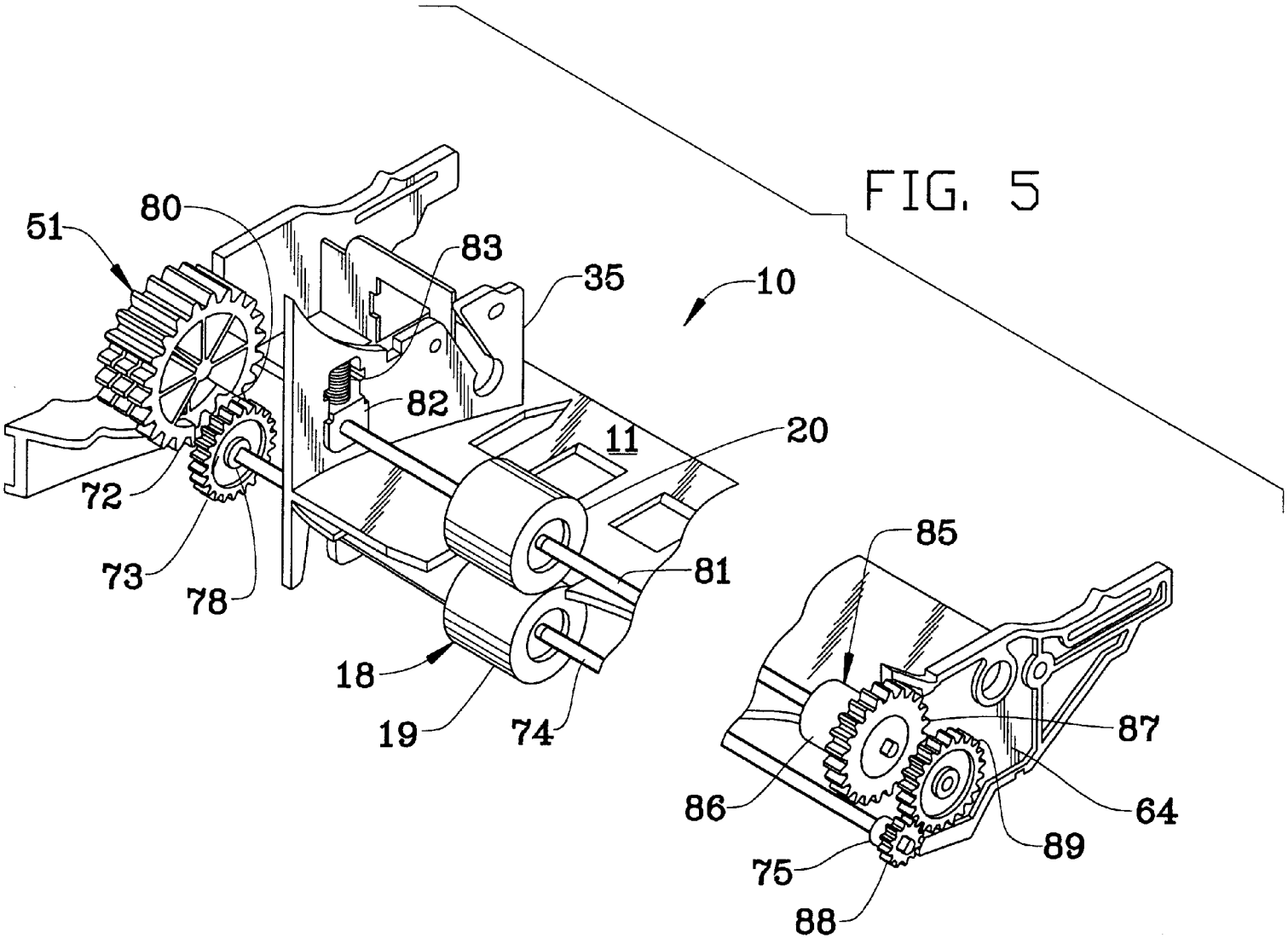
FIG. 5 is a fragmentary perspective view of a portion of the separating and feeding apparatus of the present invention and showing a separator and the relationship of its feed and restraint rolls.

The master/feed/kick gear 51 (see FIG. 5) has a third set of teeth 72 for meshing with a feed roll gear 73. The feed roll gear 73 drives a feed roll shaft 74, which has the feed roll 19 fixed thereto.

One end of the feed roll shaft 74 is supported by a bearing 75. The bearing 75 is supported by the bottom of the right side wall 64. The other end of the feed roll shaft 74 is similarly supported by a bearing 76 (see FIG. 8) in a bearing support 76' extending downwardly from the bottom surface 24 of the floor 11.

The feed roll gear 73 (see FIG. 12) is slidably mounted for axial motion along the feed roll shaft 74. The feed roll shaft 74 has a flat 77 cooperating with a flat (not shown) on the inner surface of a hub 78 of the feed roll gear 73 to cause rotation of the feed roll shaft 74 when the feed roll gear 73 is rotated.

A spring 79 continuously urges the feed roll gear 73 along the feed roll shaft 74 towards the bearing 76. This insures that the feed roll gear 73 remains in engagement with the teeth 72 (see FIG. 3) on the master/feed/kick gear 51.

The teeth 72 are interrupted by an open sector 80. The open sector 80 prevents driving of the feed roll shaft 74 (see FIG. 5) at a specific time during the feeding of the envelope 12 (see FIG. 1).

The restraint roll 20 (see FIG. 5) is fixed to a restraint roll shaft 81 for rotation therewith. One end of the restraint roll shaft 81 is rotatably supported in a bearing 82, which is supported by the left side wall 35.

A compression spring 83, which rests on top of the bearing 82, presses the restraint roll 20 against the feed roll 19. The other end of the spring 83 presses against the left side wall 35. The bearing 82 is free to move vertically but is contained axially and horizontally in the left side wall 35.

The other end of the restraint roll shaft 81 extends through a torque limiting clutch 85 and a bearing (not shown) in the right side wall 64. Two C-clips (not shown) contain the shaft 81 axially to trap it in the right side wall 64.

The torque limiting clutch 85 includes an inside hub having a flat on its inner bore mating with a flat on the right end of the restraint roll shaft 81, a wound coil spring, and an outer housing 86 made of plastic and having a gear 87 molded on one end. The torque limiting clutch 85 is mounted on the side wall 64 so that the gear 87 is exposed. The wound coil spring provides a predetermined slip torque in the drive direction.

The restraint roll shaft 81 is driven by a gear 88 on the right end of the feed roll shaft 74. The gear 88 meshes with teeth 88' (see FIG. 13) on a compound idler gear 89, which yields a 7.14 reduction ratio through its teeth 89' meshing with the gear 87 (see FIG. 5). Because the restraint roll shaft 81 is rotated in the same clockwise (as viewed from the right side of FIG. 5) direction as the feed roll 19, the surfaces at the interface of the rolls 19 and 20 are moving in opposite linear directions.

The clockwise rotation of the feed roll 19 drives the envelope 12 (see FIG. 1) towards the printer, and the restraint roll 20 (see FIG. 5) is driven in the opposite direction. By forming the restraint roll 20 of a harder polyurethane (55 Shore A hardness) than the feed roll 19 (45 Shore A hardness), the feed roll 19 has a slightly higher coefficient of friction to paper so as to have a greater tangential drive force than the restraint roll 20. Each of the rolls 19 and 20 has a coefficient of friction to paper that is much greater than the coefficient of friction between the adjacent envelopes 12 (see FIG. 1).

The biasing force created by the spring of the torque limiting clutch 85 (see FIG. 5) is selected so that the restraint roll 20 will rotate with the feed roll 19 since the torque resulting from the tangential frictional force at its surface is greater than that produced by the torque limiting clutch 85. However, the biasing force is not so large as to cause rotation of the restraint roll 20 with the feed roll 19 when more than one of the envelopes 12 (see FIG. 1) is in the nip between the rolls 19 (see FIG. 5) and 20. If it were, this would produce multiple feeding of the envelopes 12 (see FIG. 1).

Accordingly, when the rolls 19 (see FIG. 5) and 20 are rotating together to bring the envelopes 12 (see FIG. 1) into the nip, the rotation of the restraint roll 20 (see FIG. 5) in the same linear direction as the feed roll 19 helps pull the envelope 12 (see FIG. 1) into the nip where the separation can take place. The restraint roll 20 (see FIG. 5) does not rotate against the leading edge of each of the envelopes 12 (see FIG. 1) so as to damage the leading edge of each of the envelopes 12. The kick rollers 16 and 17 urge the bottom envelope 12 into the nip formed between the rolls 19 and 20.

If multiple envelopes 12 enter the nip formed between the rolls 19 and 20, the frictional force from the feed roll 19 guides the bottom envelope 12 in the direction towards the printer. However, the restraint roll 20 (see FIG. 5), which is being driven through the torque clutch 85 in the opposite direction at the nip, would tend to drive the upper envelopes 12 (see FIG. 1) in the opposite direction because the coefficient of friction of each of the rolls 19 and 20 is greater than the coefficient of friction between the envelopes 12. Therefore, the upper envelopes 12 will be stopped and thus separated from the bottom envelope. When this occurs a torsional equilibrium is reached between the torque of the torque clutch 85 (see FIG. 5) and a tangential friction force from the bottom envelope 12 (see FIG. 1) acting on the restraint roll 20 (see FIG. 5) and a tangential force generated by friction between the bottom envelope and the next upper envelope, being transmitted through the upper envelopes to the restraint roll 20 (see FIG. 5) surface by means of friction. In this state the restraint roll 20 will cease to rotate because of the balance. If two envelopes 12 do enter the nip of rolls 19 and 20, restraint roll 20 turns to drive the top envelope 12 back until this balance is reached.

The drive rolls 21 are driven from the gear 40 (see FIG. 7) of the compound gear 37. The gear 40 meshes with a first driver idler gear 90. The first driver idler gear 90 (see FIG. 6) has its hub 91 rotatably supported on the stud 53 (see FIG. 11), which rotatably supports the master cam gear 50 and the master/feed/kick gear 51.

The first driver idler gear 90 meshes with a second driver idler gear 92 (see FIG. 1). The second driver idler gear 92 has its hub 93 rotatably supported on a stud 94, which is pressed into a boss 94' (see FIG. 10) on the left side wall 35 for support thereby.

The second drive idler gear 92 (see FIG. I) meshes with a drive shaft gear 95, which is attached to a drive roll shaft 96. The drive roll shaft 96 has the drive rolls 21 fixed thereto for rotation therewith. The drive roll shaft 96 is rotatably supported in bearings (not shown) within the side walls 35 and 64.

Figure 6:
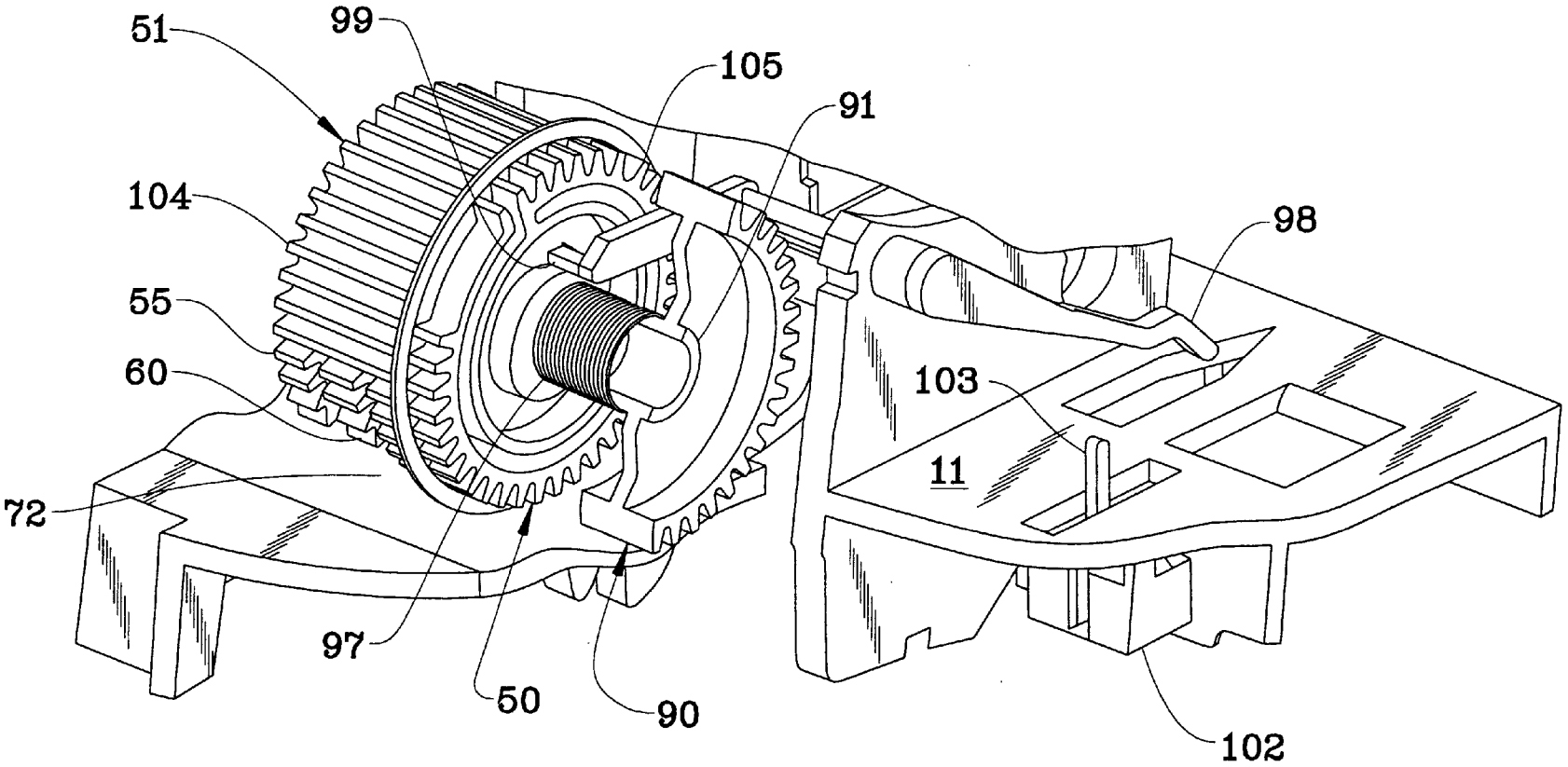
FIG. 6 is a perspective view looking towards the rear of the apparatus and showing a latch lever for stopping rotation of the master cam gear prior to the end of a cycle of operation.

As shown in FIG. 6, an over-running spring clutch 97 is located on the hub 91 of the first driver idler gear 90 and the hub 52 (see FIG. 4) of the master cam gear 50.

As the leading edge of the envelope 12 enters the nip formed between the drive rolls 21 and the back-up rolls 22, a spring biased latch lever 98 (see FIG. 6) is lifted by the envelope 12 (see FIG. 1) to dispose a latch or pawl 99 for engagement by a surface 100 (see FIG. 4) of a cam 101 on the master cam gear 50. When engagement occurs between the latch 99 (see FIG. 6) and the surface 100 (see FIG. 4) of the cam 101, rotation of the master cam gear 50 is stopped.

As the envelope 12 (see FIG. 1) exits from the nip between the drive rolls 21 and the back-up rolls 22, the latch lever 98 (see FIG. 6) is no longer supported by the envelope 12 (see FIG. 1). This results in the latch lever 98 (see FIG. 6) being pivoted to remove the latch 99 from engagement with the surface 100 (see FIG. 4) of the cam 101 on the master cam gear 50.

At the same time, the motor 15 (see FIG. 2) also stops because an optical sensor 102 (see FIG. 6) has sensed the trailing edge of the envelope 12 (see FIG. 1). The sensor 102 includes a pivotally mounted flag 103, which blocks and unblocks a beam of light. The optical sensor 102 is preferably the same as the sensor 29 (see FIG. 9).

Figure 4:
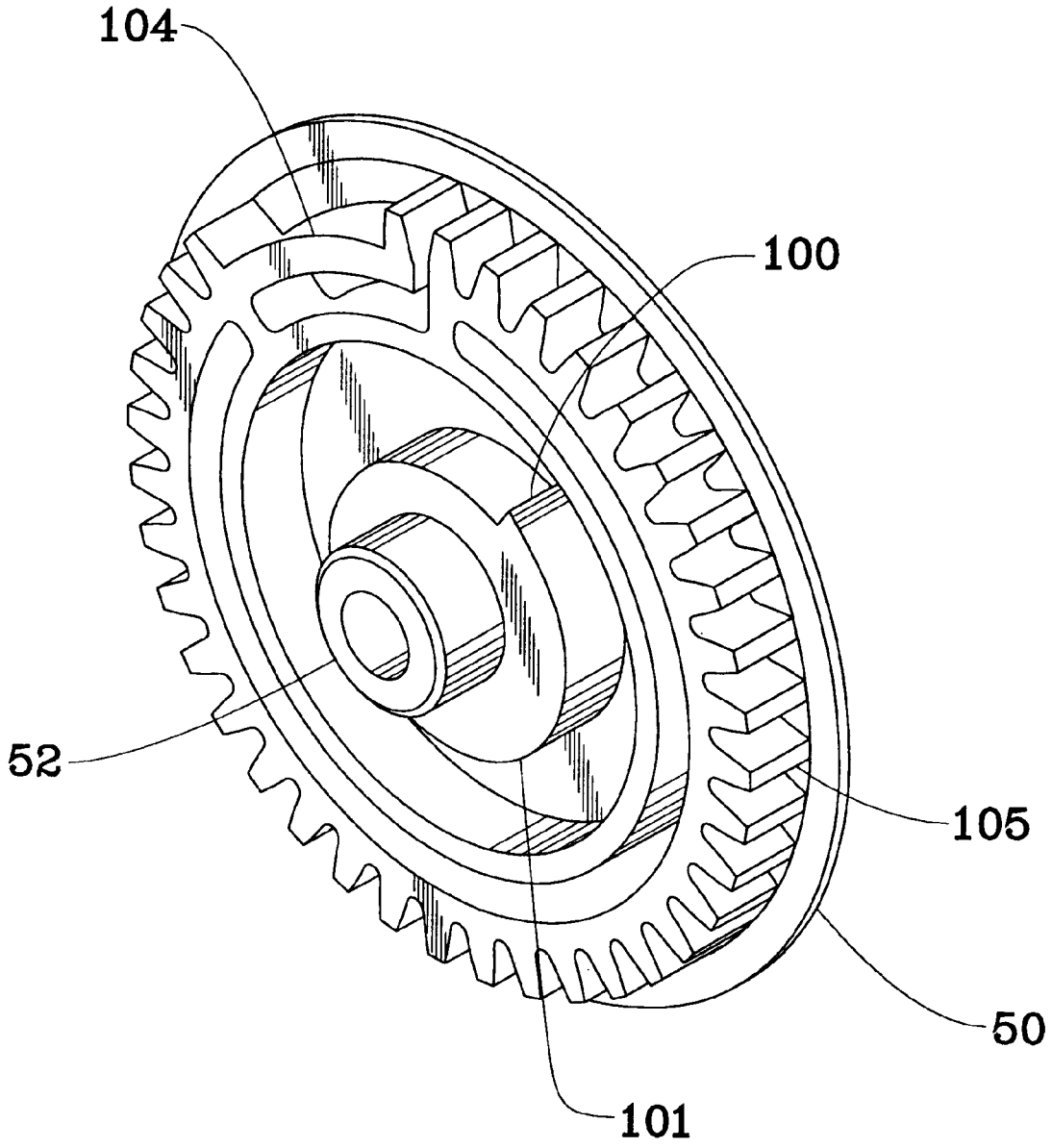
FIG. 4 is a perspective view of a master cam gear of the gear train of the present invention.

As shown in FIG. 4, the master cam gear 50 has an open sector 104 since its teeth 105 do not extend around the entire circumference. At the start of motor 15 to drive the next envelope 12, the master cam gear 50 is rotated to a position in which the teeth 105 will be ready to be engaged by gear 39 (see FIG. 1). This occurs through friction from the over-running spring clutch 97 (see FIG. 6), which transmits sufficient force to allow the master cam gear 50 to be turned to the position in which the teeth 105 are disposed for cooperation with the gear 39 (see FIG. 1).

As previously mentioned, the master cam gear 50 (see FIG. 6) is released when the spring biased latch lever 98 is no longer raised by one of the envelopes 12 (see FIG. 1) passing therebeneath.

Because the master cam gear 50 (see FIG. 4) has the open sector 104 due to some of the teeth 105 missing and the master/feed/kick gear 51 (see FIG. 3) has the open sectors 70, 71, and 80 because of some of the teeth 55, 60, and 72, respectively, missing, each of the two gears 50 (see FIG. 6) and 51 is deemed to be a gear clutch.

When the master cam gear 50 (see FIG. 6) is latched by the latch lever 98, the open sector 104 of the master cam gear 50 is located where there would be meshing with the compound gear 39 (see FIG. 1). This stops rotation of the coupled gears 50 (see FIG. 6) and 51.

While the apparatus 10 (see FIG. 1) has been described as being used with a printer, it should be understood that the apparatus 10 could be employed with any other mechanism in which it is desired to have the envelopes 12 fed thereto.

Because the master cam gear 50 (see FIG. 4) is not latched until the envelopes 12 (see FIG. 1) have passed the drive rolls 21, the mechanism continues to cycle until one of the envelopes 12 (see FIG. 1) has reached the drive rolls 21. This improves the reliability for feeding the envelopes 12 that are difficult to feed into the nip formed between the feed roll 19 and the restraint roll 20.

An advantage of this invention is that it does not require any reversal of the drive motor to begin a feed cycle. Another advantage of this invention is that more than one cycle to feed an envelope may be attempted before the drive motor is turned off. A further advantage of this invention is that feeding from the bottom of the stack of envelopes occurs without the kick rollers or the feed roll acting on the next envelope in the stack because of the controlled stopping of the kick rollers and the feed roll in accordance with the minimum length of an envelope to be fed.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. An automatic separating and feeding apparatus for feeding a lowermost envelope from a stack of envelopes including:

first and second engaging means for engaging the lowermost envelope from a stack of envelopes at spaced longitudinal portions thereof;

control means for rendering said first engaging means ineffective prior to rendering said second engaging means ineffective, said control means including:

first rendering means for rendering said first engaging means ineffective prior to the trailing edge of the advancing envelope passing said first engaging means; and second rendering means for rendering said second engaging means ineffective prior to the trailing edge of the advancing envelope passing said second engaging means but after said first rendering means is effective;

separating means for allowing only advancement of the lowermost of the envelopes from the stack of envelopes, said separating means being downstream of each of said first engaging means and said second engaging means;

advancing means for advancing the envelope to a process station, said advancing means being downstream of said separating means;

sensing means for sensing when the advancing envelope has been advanced past said advancing means by said advancing means; and responsive means responsive to said sensing means for stopping a cycle of operation.

2. The apparatus according to claim 1 including:

a unidirectional motor;

causing means for causing said unidirectional motor to activate said first engaging means, said second engaging means, said separating means, and said advancing means;

and said responsive means inactivating said unidirectional motor to stop a cycle of operation.

3. The apparatus according to claim 2 including means for inactivating said separating means prior to inactivation of said unidirectional motor.

4. The apparatus according to claim 1 including:

a single power source for activating said first engaging means, said second engaging means, said separating means, and said advancing means;

and said responsive means inactivating said single power source to stop a cycle of operation.

5. The apparatus according to claim 4 including means for inactivating said separating means prior to inactivation of said unidirectional motor.

6. An automatic separating and feeding apparatus for feeding a lowermost envelope from a stack of envelopes including:

a single power source;

a first set of kick rollers for engaging the lowermost of the envelopes in the stack for advancing the lowermost envelope from the stack;

a second set of kick rollers for engaging the lowermost of the envelopes in the stack for advancing the lowermost envelope from the stack, said second set of kick rollers being downstream from said first set of kick rollers;

connecting means for connecting said first set of kick rollers and said second set of kick rollers to said single power source for rotating each of said first set of kick rollers and said second set of kick rollers;

said connecting means including:

first disconnecting means for disconnecting said first set of kick rollers from said single power source prior to the trailing edge of the advancing envelope passing said first set of kick rollers to stop rotation of said first set of kick rollers;

and second disconnecting means for disconnecting said second set of kick rollers from said single power source prior to the trailing edge of the advancing envelope passing said second set of kick rollers to stop rotation of said second set of kick rollers;

separating means for allowing only advancement of the lowermost of the envelopes in the stack of envelopes from the stack, said separating means being downstream from each of said first set of kick rollers and said second set of kick rollers;

a set of drive rolls downstream from said separating means;

drive roll connecting means including means for connecting said drive rolls to said single power source;

and sensing means for sensing when the advanced envelope has been advanced past said drive rolls for causing disconnection of said drive rolls from said single power source to end a cycle of operation.

7. The apparatus according to claim 6 in which said single power source is a unidirectional motor.

8. The apparatus according to claim 7 including means for inactivating said separating means prior to inactivation of said unidirectional motor.

9. The apparatus according to claim 6 including means for inactivating said separating means prior to inactivation of said single power source.

10. An automatic separating and feeding apparatus for feeding a lowermost envelope from a stack of envelopes including:

a single power source;

a first shaft having a first set of kick rollers mounted thereon for engaging the lowermost of the envelopes in the stack for advancing the lowermost envelope from the stack;

first gear means connected to said first shaft;

a second shaft having a second set of kick rollers for engaging the lowermost of the envelopes in the stack for advancing the lowermost envelope from the stack, said second set of kick rollers being downstream of said first set of kick rollers;

second gear means connected to said second shaft;

a first gear driven by said single power source;

said first gear including:

a first set of teeth for meshing with said first gear means, said first set of teeth extending for less than the circumference of said first gear to stop rotation of said first shaft prior to the trailing edge of the advancing envelope passing said first set of kick rollers to stop rotation of said first set of kick rollers;

a second set of teeth for meshing with said second gear means, said second set of teeth extending for less than the circumference of said first gear to stop rotation of said second shaft prior to the trailing edge of the advancing envelope passing said second set of kick rollers to stop rotation of said second set of kick rollers, said second set of teeth extending further around the circumference of said first gear than said first set of teeth; separating means for allowing only advancement of the lowermost of the envelopes in the stack of envelopes from the stack, said separating means being downstream of each of said first set of kick rollers and said second set of kick rollers;

said separating means including:

a feed roll shaft having a feed roll mounted thereon for rotation therewith;

a restraint roll shaft having a restraint roll mounted thereon for rotation therewith;

and third gear means connected to said feed roll shaft;

said first gear including a third set of teeth for meshing with said third gear means, said third set of teeth extending further around the circumference of said first gear than said second set of teeth;

said third gear means driving said restraint roll shaft in the same rotary direction as said feed roll shaft;

said restraint roll shaft being subjected to a torque to limit when said restraint roll shaft rotates in the same direction as said feed roll shaft to control when said restraint roll shaft ceases to rotate in the same rotary direction as said feed roll shaft; advancing means for advancing the envelope to a process station, said advancing means being downstream of said separating means;

fourth gear means connected to said advancing means;

a second gear driven by said single power source and rotating said fourth gear means;

mechanical stopping means for stopping rotation of said first gear after the leading edge of the advancing envelope has passed said separating means;

means for causing said single power source to stop after the trailing edge of the advancing envelope has passed said advancing means;

and means for rendering said mechanical stopping means ineffective after the trailing edge of the advancing envelope has passed said separating means.

11. The apparatus according to claim 10 in which said single power source is a unidirectional motor.

12. The apparatus according to claim 11 in which said advancing means includes:

a drive roll shaft having a plurality of drive rolls mounted thereon downstream of said separating means;

resiliently biased back-up rolls cooperating with said drive rolls to form a nip therebetween;

and said fourth gear means connected to said drive roll shaft.

13. The apparatus according to claim 10 in which said advancing means includes:

a drive roll shaft having a plurality of drive rolls mounted thereon downstream of said separating means;

resiliently biased back-up rolls cooperating with said drive rolls to form a nip therebetween;

and said fourth gear means connected to said drive roll shaft.

* * * * *